US009247360B2

(12) United States Patent
Barth et al.

(10) Patent No.: US 9,247,360 B2
(45) Date of Patent: Jan. 26, 2016

(54) HEARING INSTRUMENT HOUSING HAVING A PLUG-IN CONNECTION, PLUG AND HEARING INSTRUMENT

(71) Applicant: SIVANTOS PTE. LTD., Singapore (SG)

(72) Inventors: Joachim Roland Barth, Nuremberg (DE); Holger Kral, Fuerth (DE); Frank Naumann, Erlangen (DE); Andreas Ratay, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 24 days.

(21) Appl. No.: 14/159,837

(22) Filed: Jan. 21, 2014

(65) Prior Publication Data

US 2014/0205120 A1 Jul. 24, 2014

(30) Foreign Application Priority Data

Jan. 18, 2013 (DE) ..... 20 2013 000 547 U

(51) Int. Cl.
*H04R 25/00* (2006.01)
*G10K 11/22* (2006.01)

(52) U.S. Cl.
CPC ..... *H04R 25/65* (2013.01); *G10K 11/22* (2013.01); *H04R 25/60* (2013.01); *H04R 2225/63* (2013.01)

(58) Field of Classification Search
CPC .... H04R 2225/63; H04R 25/60; H04R 25/65; H04R 2225/021; H04R 25/02; H04R 25/556; H04R 25/602; H04R 25/608; H04R 25/654; H04R 25/656; H04R 25/658; H04R 1/10; H04R 1/1008; H04R 1/105; H04R 1/1091; H04R 2201/105
USPC ..... 381/322, 323, 312, 314, 324, 326, 328, 381/330, 327
See application file for complete search history.

(56) References Cited

U.S. PATENT DOCUMENTS

| | | | | |
|---|---|---|---|---|
| 7,221,770 | B2 * | 5/2007 | Fickweiler et al. | 381/330 |
| 8,098,865 | B2 * | 1/2012 | Ho et al. | 381/330 |
| 2008/0298619 | A1 * | 12/2008 | Kral et al. | 381/330 |
| 2011/0268304 | A1 * | 11/2011 | Ang et al. | 381/330 |
| 2014/0003638 | A1 * | 1/2014 | Barth et al. | 381/314 |
| 2014/0119586 | A1 * | 5/2014 | Mortensen et al. | 381/330 |
| 2014/0205120 | A1 * | 7/2014 | Barth et al. | 381/322 |

* cited by examiner

*Primary Examiner* — Davetta W Goins
*Assistant Examiner* — Phylesha Dabney
(74) *Attorney, Agent, or Firm* — Laurence A. Greenberg; Werner H. Stemer; Ralph E. Locher

(57) ABSTRACT

A hearing instrument has housing with a plug-in connection. The plug-in connection connects hearing tubes, sound tubes or electrical signal lines. The hearing instrument ensures against an unintentional detachment of the tubes and lines from the housing. The housing has a locking apparatus. The plug-in connection is arranged in the housing. The locking apparatus is embodied to prevent an unintentional detachment of the plug in the plug-in connection. The locking apparatus includes a catch, with a latching plate, and being moveably mounted in the housing. The catch moves at right angles to the plug-in direction of the plug and the latch is pushed into the housing and is protected herein by a blocking facility against unintentionally being pushed out. The blocking facility includes a stop and a blocking element, against which the stop strikes when sliding out. With the moveable catch, an easy-to-operate locking process is achieved.

10 Claims, 3 Drawing Sheets

HEARING INSTRUMENT HOUSING HAVING A PLUG-IN CONNECTION, PLUG AND HEARING INSTRUMENT

CROSS-REFERENCE TO RELATED APPLICATION

This application claims the priority, under 35 U.S.C. §119, of German application DE 20 2013 000 547.5, filed Jan. 18, 2013; the prior application is herewith incorporated by reference in its entirety.

BACKGROUND OF THE INVENTION

Field of the Invention

The invention relates to a hearing instrument housing having a plug-in connection. Such plug-in connections can be provided for instance in order to connect hearing tubes, sound tubes or electrical signal lines.

Hearing instruments can be embodied for instance as hearing devices. A hearing device is used to supply a hearing-impaired person with acoustic ambient signals which are processed and amplified in order to compensate for or treat the respective hearing impairment. It consists in principal of one or a number of input transducers, a signal processing facility, an amplification facility and an output transducer. The input transducer is generally a sound receiver, e.g. a microphone, and/or an electromagnetic receiver, e.g. an induction coil. The output transducer is usually implemented as an electroacoustic converter, e.g. a miniature loudspeaker, or as an electromechanical converter, e.g. a bone conduction earpiece. It is also referred to as an earpiece or receiver. The output transducer generates output signals, which are routed to the ear of the patient and are to generate a hearing perception in the patient. The amplifier is generally integrated in the signal processing facility. Power is supplied to the hearing device by a battery integrated in the hearing device housing. The essential components of a hearing device are generally arranged on a printed circuit board as a circuit substrate and/or connected thereto.

Hearing instruments can be embodied both as hearing devices and also as so-called tinnitus maskers. Tinnitus maskers are used to treat tinnitus patients. They generate acoustic output signals which depend on the respective hearing impairment and, depending on the working principle, also on ambient noises, the output signals possibly contributing to reducing the perception of interfering tinnitus or other ear noises.

Furthermore, hearing instruments can also be embodied as telephones, cell phones, headsets, earphones, MP3 players or other electronic telecommunication or entertainment systems.

The term hearing instrument is to be understood below to mean both hearing devices, and also tinnitus maskers, comparable devices of such types as well as electronic telecommunication and entertainment systems.

Hearing instruments, in particular hearing devices, are known in various basic types. With in-the-ear (ITE) hearing devices, a housing containing all functional components including microphone and receiver is worn at least partially in the auditory canal. Completely-in-canal (CIC) hearing devices are similar to ITE hearing devices, but are however worn completely in the auditory canal. With behind-the-ear (BTE) hearing devices, a housing with components such as battery and signal processing facility is worn behind the ear and a flexible sound tube, also referred to as tube, routes the acoustic output signals of a receiver from the housing to the auditory canal, where an earpiece on the tube is frequently provided to reliably position the tube end in the auditory canal. Receiver-in-canal, behind-the-ear (RIC-BTE) hearing devices are similar to BTE hearing devices, but the receiver is nevertheless worn in the auditory canal and instead of a sound tube. A flexible receiver tube routes electrical signals, instead of acoustic signals, to the receiver, which is attached to the front of the receiver tube, in most instances in an earpiece used for reliably positioning within the auditory canal. RIC-BTE hearing devices are frequently used as so-called open-fit devices, in which the auditory canal remains open for the passage of sound and air in order to reduce the interfering occlusion effect.

Aside from the hearing device types to be worn on or in the ear having an acoustic receiver, cochlea implants and bone conduction hearing devices (BAHA, Bone Anchored Hearing Aid) are also known.

A common aim with all hearing device types is to have the smallest possible housings and/or designs in order to increase wearing comfort, if necessary to improve the implant ability and if necessary to reduce the visibility of the hearing device for cosmetic reasons.

Hearing instruments are used to this end to generate acoustic signals which are to be made perceptible to the hearing instrument wearer. The acoustic signals are generated by loudspeakers, which are also referred to as receivers or earpieces. In this respect, the loudspeakers could be arranged in or outside of the hearing instrument housing. In hearing instruments, the housings of which are not already worn in the ear, the acoustic or electrical signals must be routed to the ear. Tube-type lines or cables are required for this, which are also referred to as sound tubes or earpiece tubes or tubes. Furthermore, input signals can also be routed to the hearing instrument housing by way of such lines, for instance from separate electronic entertainment devices.

It is desirable to detachably connect such lines to the hearing instrument housing. Therefore, detachable plug-in connections are generally provided. These plug-in connections must reliably establish contact, be protected against contamination and moisture and should not have the tendency to unintentionally detach.

SUMMARY OF THE INVENTION

The object underlying the invention consists in specifying a hearing instrument with a plug-in connection, which is reliably protected against unintentional detachment.

A basic idea behind the invention consists in a housing for a hearing instrument having a locking apparatus for a plug-in connection, which plug-in connection is formed from a plug-in connector and a plug, wherein the plug-in connector is arranged in the housing. The locking apparatus is embodied so as to prevent an unintentional detachment of the plug-in connection. The locking apparatus includes a catch, which has at least one latching plate, and which is moveably mounted in the housing between an unlocked and a locked position. The catch is moved at right angles to the plug-in direction of the plug and wherein the catch is pushed into the housing and is secured herein against unintentional sliding out by a blocking facility. The blocking facility includes a stop on the catch side and a blocking element on the housing side, against which the stop of the catch strikes when it is pushed out.

With the aid of the moveable catch, an easy-to-operate locking mechanism is achieved. In addition, uncomplicated assembly and/or manufacture is enabled by the catch being pushed into the housing. Furthermore, operation is further simplified by the catch herewith being protected against being pushed out, since there is no need to be concerned about an unintentional removal and loss of the catch.

An advantageous development of the basic idea consists in the bearing on the housing side, in which the catch can be moveably mounted, being separated from the inside of the housing. The opening needed to support the catch and for its uncomplicated installation disadvantageously also allows for the entry of impurities or moisture. Separation of the catch bearing and housing interior prevents impurities or moisture from being able to penetrate through the catch bearing to sensitive electronic components arranged in the housing.

A further advantageous development of the basic idea consists in the blocking element on the housing side being embodied as a separate component, wherein a recess for receiving the blocking element is provided in the housing. A structurally uncomplicated blocking of the catch is herewith achieved in the housing. The blocking may also be uncomplicated in terms of assembly if the housing and blocking element are provided with a snap-fit engagement for instance and the blocking element thus automatically engages in the housing.

A further advantageous development of the basic idea consists in the catch having two latching plates. On the one hand two latching plates ensure greater stability and in this respect can if necessary each be dimensioned smaller per se. On the other hand, a symmetrical arrangement can be achieved by two latching plates, thereby preventing a canting or tilting of the plug in the plug-in connector.

A further advantageous development of the basic idea consists in a recess for receiving a holding element of the plug being provided in the plug-in connector. Such a recess, in cooperation with the aforesaid locking mechanism, provides a structural requirement for a simple-to-operate and reliably closing plug-in connection.

A further basic idea of the invention consists in a plug for a plug-in connector of a housing, such as the hearing instrument explained in detail above, wherein the plug has at least one latching plate stop, which is arranged such that it allows for insertion of the plug into the plug-in connector, if the catch is in the unlocked position, and which, when the plug is pulled from the plug-in connector, strikes against the latching plate if the catch is in the locked position.

With the aid of the latching plate stop, an easy-to-operate locking process is achieved. In addition, uncomplicated installation and/or manufacture is enabled by the catch being pushed into the housing. Furthermore, operation is further simplified by the catch being protected against being pushed out, since there is no need to be concerned about an unintentional removal and loss of the catch.

An advantageous development of the basic idea consists in the latching plate stop having a lower mechanical stability than the latching plate, the catch and the bearing of the catch in the housing of the hearing instrument, such that when the plug is pulled out from the plug-in connector, if the catch is in the locked position, the latching plate stop breaks before the said further components become damaged. A rupture joint is produced in this way, which ensures that neither the housing nor the catch on the housing side are damaged as a result of damaged caused by faulty operation of the plug. The plug is less expensive and can be easily replaced. Furthermore, plugs of this type are generally replacement parts provided for replacement purposes, and are therefore advantageously easily available.

A further advantageous development of the basic idea consists in the catch having two latching plate stops. On the one hand two latching plate stops ensure greater stability and in this respect can if necessary each be dimensioned smaller per se. On the other hand, a symmetrical arrangement can be achieved by two latching plate stops, thereby preventing a canting or tilting of the plug in the plug-in connector.

A further advantageous development of the basic idea consists in the plug having a holding element which is embodied so as to engage in the counter bearing provided herefor in the plug-in connector upon insertion of the plug into the plug-in connector. Together with the aforesaid recess and in cooperation with the aforesaid locking mechanism, such a holding element provides a structural requirement for a simple-to-operate and reliably closing plug-in connection.

A further advantageous development of the basic idea consists in the plug being connected to one end of a tube, and upon insertion of the plug into the plug-in connector, closing at least one electrical and/or acoustic connection between the housing and the tube, and wherein the tube includes at least one electrical and/or acoustic line. The plug-in connection is thus advantageously suited to a BTE hearing device or a RIC-BTE hearing device.

A further basic idea of the invention consists in a hearing instrument having a housing embodied as explained above and a plug embodied as explained above. A BTE hearing device or a RIC-BTE hearing device with a plug-in connection is thus advantageously produced with an easy-to-operate locking mechanism. In addition, uncomplicated assembly and/or manufacture is enabled by the catch being pushed into the housing. Furthermore, operation is further simplified by the catch being protected against sliding out, since there is no need to be concerned an unintentional removal and loss of the catch.

Other features which are considered as characteristic for the invention are set forth in the appended claims.

Although the invention is illustrated and described herein as embodied in a hearing instrument housing having a plug-in connection, a plug and a hearing instrument, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
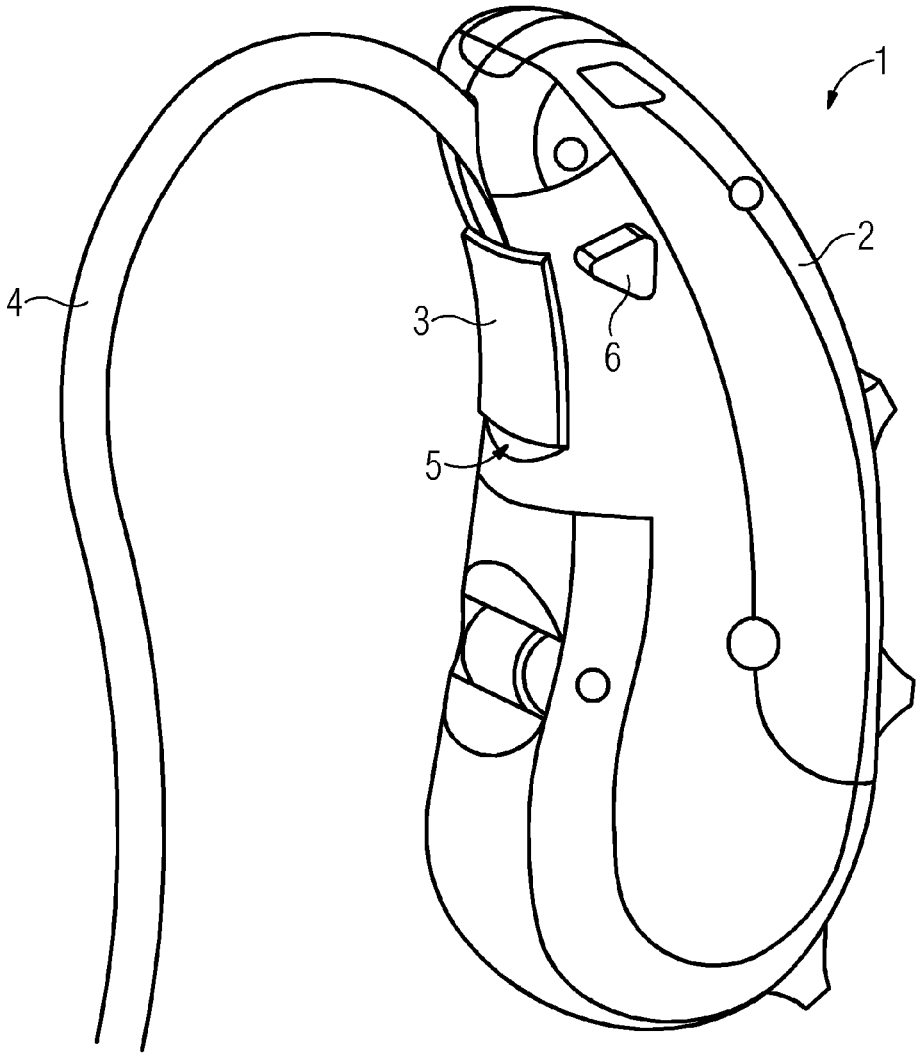
FIG. 1 is a diagrammatic, perspective view of a hearing instrument with a housing and a plug.

Referring now to the figures of the drawings in detail and first, particularly to FIG. 1 thereof, there is shown a perspective representation of a hearing instrument 1 with a housing 2 and a plug 3. A tube 4, not shown completely, attaches to the plug 3.

The housing 2 includes a locking mechanism, which is mostly concealed by the housing 2 and the plug 3 and can thus not be identified in FIG. 1. Only the end of a moveable catch 6 protrudes from the housing 2. The plug 3 is inserted into a plug-in connector 5 of the housing.

Further features of the housing 2 are not required to explain the invention and are therefore not referred to in more detail.

Figure 2:
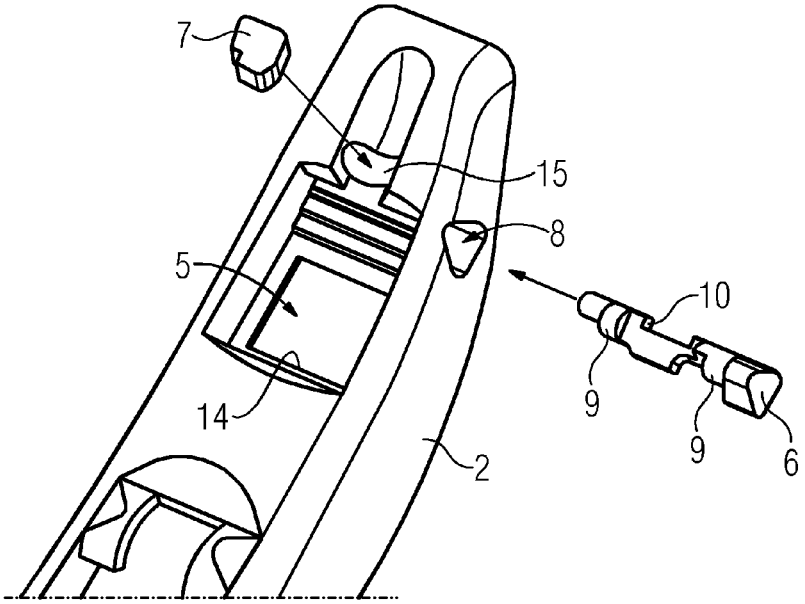
FIG. 2 is a perspective, partial view of the housing with a separate catch.

FIG. 2 shows a perspective representation of the housing 2 without the plug 3 and with a removed, separate catch 6. Only the region of the housing 2 in which the plug-in connector 5 is arranged is shown here.

In the broadest sense 5, the plug-in connector 5 is embodied as a socket and/or female connector, into which the plug 3 can be inserted. A receptacle 14 for a holding element of the plug 3 can be seen in the region of the plug-in connector shown below. The receptacle 14, which is not visibly shown in the figure, is embodied as an undercut, below or behind which a holding element of the plug can be pushed.

A locking apparatus is arranged on the side of the plug-in connector 5 facing the receptacle 14. The locking apparatus includes the catch 6 as an essential component. The catch 6 has two latching plates 9, the function of which is explained again below.

In addition, the catch 6 has a stop 10. The catch 6 is pushed into a bearing in the housing 2 embodied as a catch guide 8. Once the catch 6 is completely pushed into the catch guide 8, the stop 10 is disposed in the region of a counter bearing 15. A blocking element 7 is used there as soon as the catch 6 is pushed in. The blocking element 7 with the edge shown to the left in FIG. 3 prevents the catch 6 from being able to be pushed out of the housing 2, by the stop 10 striking against the edge of the blocking element 7.

As explained again below, the catch 6, provided it is pushed fully into the housing 2 and is installed in the blocking element 7, still has a limited mobility, so as to be able to be moved between a locked and an unlocked position.

The catch guide 8 which supports the catch 6 moveably in the housing 2, although it represents an opening in the housing 2, is not connected to the interior of the housing 2. Impurities and moisture can in this way only pass through the opening in the catch guide 8 into the catch guide 8 and not from there to sensitive components, which are arranged inside the housing 2.

The blocking element 7, which, after the catch 6 is pushed in, is inserted into the counter bearing 15, engages, as described, with its edge facing the catch-side stop 10, into the stop 10 and/or the recess in the region of the stop 10.

The blocking element 7 is embodied as a separate component, which is not permanently connected to the housing from the outset. It can be glued in the region of the counter bearing 15 for instance. The counter bearing 15 can advantageously be embodied such that it makes a re-releasable, form-fit connection with the blocking element 7, the connection possibly being embodied as a snap-in or clip-in closure.

In a further non-illustrated embodiment, the blocking element 7 can also be rigidly connected to the housing 2 and can be integrated there as an elastic snap-fit engagement, for instance locking pin. Such an embodiment would however render necessary a more complex form of the housing 2, which would be more complicated in terms of manufacture, but would however on the other hand be advantageous in that the blocking element 7 is not a separate, loose component, which can get lost. Since however the blocking element 7 does not have to be removed for everyday use of the hearing instrument 1, detachment and loss of the same is improbable, so that the embodiment of the blocking element 7 shown in the figure as a separate, loose component does not represent any major disadvantage.

Figure 3:
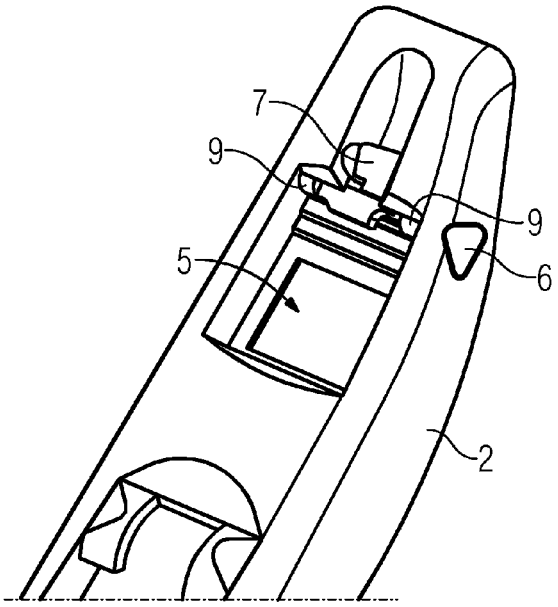
FIG. 3 is a perspective, partial view of the housing with a catch in a locked position.

In FIG. 3 the housing 2 including the catch 6 is shown schematically in the locked position of the catch 6. In the locked position, the catch 6 is pushed completely into the housing 2, in other words, is flush with the outer side of the housing wall. The blocking element 7 is installed in the housing 2, so that the catch 6 is protected against being pushed out from the catch guide.

In the completely pushed-in, locked position of the catch 6, the latching plates 9 are likewise pushed in as far as possible, in other words, likewise into their locked position. The latching plates 9 effect a locking of the plug connection, in other words, of the plug 3 in the plug-in connector 5 in the manner to be explained again below.

In the figure shown, the plug 3 is however not inserted.

Figure 4:
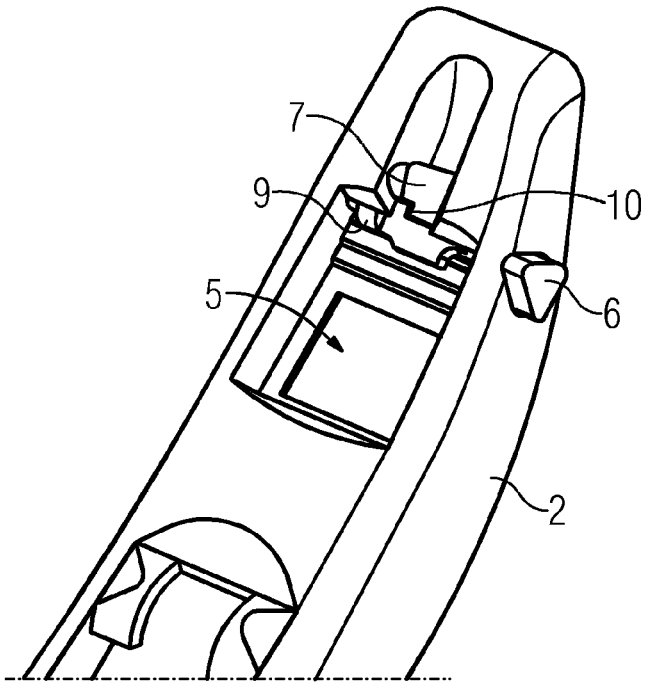
FIG. 4 is a perspective, partial view of the housing with the catch in an unlocked position.

FIG. 4 shows the housing 2 and the catch 6 in an unlocked position. The end of the catch 6 protrudes in a non-flush manner beyond the outer wall of the housing 2.

As above, no plug 3 is likewise inserted in the plug-in connector 5. However, in the unlocked position of the catch 6 shown, the plug 3 could be both inserted and also pulled out of the connector. This is because the latching plates 9, of which only one can be seen in the selected view, are likewise disposed in their unlocked position. In other words, the latching plates 9, in the unlocked position of the catch 6, release the path for insertion or removal of the plug 3.

In the unlocked position of the catch 6 shown, this is pulled out as far as the blocking element 7 allows. This end position of the catch 6 is predetermined in that the stop 10 on the catch side strikes the adjacent edge of the blocking element 7. In other words, the blocking element 7 blocks a passage of the stop 10 and thus prevents further movement of the catch 6. When the blocking element 7 is installed, the catch 6 can thus be moved between the fully inserted, locked position, and the pushed-out, unlocked position shown.

Figure 5:
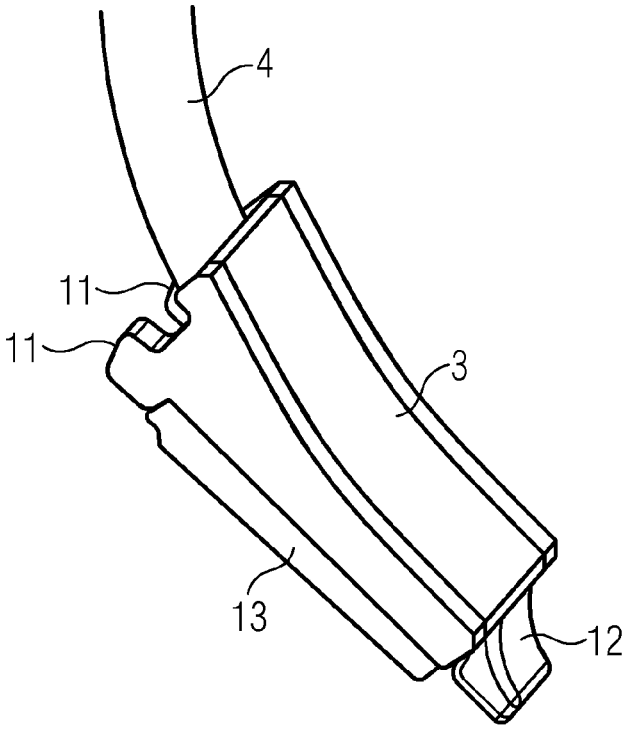
FIG. 5 is a perspective view of the plug with a latching plate stop.

FIG. 5 shows a perspective representation of the plug 3 with latching plate stops 11. The plug is connected to the tube 4, which is not reproduced in its entirety. It has a holding element 12, which, in order to insert the plug into the aforesaid plug-in connector 5 of the housing 2, is pushed in such that it is moved below the receptacle 14 embodied as an undercut. As a result, the side of the plug 3, on which the holding element 12 is arranged, is held in the plug-in connector 5 and protected against a sliding out or pulling out of the plug 3.

The latching plate stops 11 are arranged on the side of the plug 3 facing the holding element 12. These are moved past the latching plates 9 upon insertion of the plug 3 into the plug-in connector 5. To this end, the catch 6, as shown above, must be in the unlocked position. On the other hand, the latching plates 9 block the path of the latching plate stops 11 upon insertion of the plug.

Once the plug 3 is completely inserted into the plug-in connector 5, the catch 6, in the locked position, can be push into the housing 2 and/or the catch guide 8 completely. As a result, the latching plates 9 of the catch 6 mutually engage with the latching plate stops 11 of the plug 3.

In the perspective selected in the figure, the latching plates 9 of the catch 6 slide, upon locking, across the edge visible at the top of the latching plate stop 11 which can be seen on the left. In the same way, the further latching plate 9 moves over the latching plate stop 11 which is not fully visible. As a result, the plug on the side in the plug-in connector 5 facing the holding element 12 is protected against pulling out or sliding out. In this way the plug-in connection produced by the plug 3 and the plug-in connector 5 is protected and/or locked against unintentional detachment.

In order to prevent damage due to inappropriate tensile stress of the plug 3, e.g. by way of the hose 4, the latching plate stops 11 are embodied as rupture points. To this end, they are embodied to be mechanically less stable than the latching plates 9 and the catch 6 and the catch guide 8 in the housing 2. As a result, the latching plate stops 11 break in the case of an excessive tensile stress, before the catch 6 or the housing 2 break and/or can cause damage. As soon as the latching plate stops 11 are broken for the first time, the plug 3 is no longer locked in the plug-in connector 5, and can therefore be slid out and/or pulled out.

The embodiment of the latching plate stops 11 in the manner described as rupture points can be achieved on the one hand by a sufficiently small dimensioning of its geometric dimensions. On the other hand, lateral narrower sections or webs can be integrated into the outer shape of the latching plate stops 11, this is not shown in the figure. Furthermore, they can be manufactured from softer or more fragile material compared with the components to be protected, in other words above all catch 6 and housing 2.

The contact area of the plug is disposed on the side of the plug 3 facing the housing 2, upon insertion of the plug 3, in the figure shown below. It is surrounded by a sealing lip 13 which can be seen in the figure. Both electrical and also acoustic contact elements, which are used to electrically or acoustically connect the plug 3 to the housing, can be found in the contact region.

Upon insertion of the plug 3, these electrical or acoustic connections with the housing 2 are closed. For instance, an earpiece can be arranged in the housing 2, the acoustic output signals of which are routed via a connection of this type through the plug 3 into the tube 4. Similarly, an amplifier can be arranged in the housing 2, the electrical output signals of which pass through the plug 3 into the tube 4. The electrical or acoustic signals can be routed through the tube 4 to an earpiece for instance, which is worn as intended in an auditory canal of a hearing instrument wearer.

Conversely, the plug 3 can however also be provided to supply electrical or acoustic signals coming from the tube 4 or originating from an external source to the housing 2 of the hearing instrument 1.

The invention claimed is:

1. A housing configuration for a hearing instrument, comprising:

a housing body;

a blocking facility having a blocking element disposed in said housing body;

a plug-in connector for receiving a plug, said plug-in connector formed in said housing body;

a locking apparatus for said plug-in connector, said locking apparatus embodied to prevent an unintentional detachment of the plug in said plug-in connector, said locking apparatus having a catch with at least one latching plate and a stop, and being moveably mounted in said housing body between an unlocked position and a locked position, said catch being moved at right angles to a plug-in direction of the plug, said catch being pushed into said housing body and is protected herein against unintentionally being pushed out by said blocking facility, said blocking facility including said stop of said catch on a catch side and said blocking element on a housing side, against which said stop of said catch strikes when being pushed out; and said housing body having a bearing on said housing side, and in said bearing said catch is moveably mounted and is separate from an inside of said housing body.

2. The housing configuration according claim 1, wherein:

said blocking element is embodied as a separate component from said housing body; and said housing body having a recess formed therein for receiving said blocking element.

3. The housing configuration according to claim 1, wherein said latching plate of said catch is one of two latching plates.

4. The housing configuration according to claim 1, further comprising a counter bearing for receiving a holding element of the plug and disposed in said plug-in connector.

5. A plug for a plug-in connection of a housing of a hearing instrument, the housing further having a catch with at least one latching plate, the plug comprising:

at least one latching plate stop disposed such that said latching plate stop allows an insertion of the plug into the plug-in connection, if the catch is in an unlocked position, and said latching plate stop upon pulling-out of the plug from the plug-in connection, strikes against the latching plate, if the catch is in the locked position.

6. The plug according to claim 5, wherein said latching plate stop has a lower mechanical stability than the latching plate, the catch and a bearing of the catch in the housing of the hearing instrument such that when removing the plug from the plug-in connection, if the catch is in the locked position, the latching plate stop breaks before further components become damaged.

7. The plug according to claim 5, wherein said latching plate stop is one of two latching plate stops.

8. The plug according to claim 5, further comprising a holding element, which is embodied, upon insertion of the plug into the plug-in connection, to engage in a counter bearing provided therefore in the plug-in connection.

9. The plug according to claim 5, wherein the plug is connected to an end of a tube and upon insertion of the plug into the plug-in connection closes at least one electrical and/or acoustic connection between the housing and the hose, and hose includes at least one electrical and/or acoustic line.

10. A hearing instrument, comprising:

a plug having at least one latching plate stop;

a housing configuration, containing:

a housing body;

a blocking facility having a blocking element and disposed in said housing body;

a plug-in connector for receiving said plug and formed in said housing body;

a locking apparatus for said plug-in connector, said locking apparatus embodied to prevent an unintentional detachment of said plug in said plug-in connector, said locking apparatus having a catch with at least one latching plate and a stop, and being moveably mounted in said housing body between an unlocked position and a locked position, said catch being moved at right angles to a plug-in direction of said plug, said catch being pushed into said housing body and is protected herein against unintentionally being pushed out by said blocking facility, said blocking facility including said stop of said catch on a catch side and said blocking element on a housing side, against which said stop of said catch strikes when being pushed out; and said least one latching plate stop disposed such that said latching plate stop allows an insertion of said plug into said plug-in connector, if said catch is in the unlocked position, and said latching plate stop upon pulling-out of said plug from said plug-in connector, strikes against said latching plate, if said catch is in the locked position.

* * * * *